US012139881B2

(12) United States Patent
Matsuyama

(10) Patent No.: US 12,139,881 B2
(45) Date of Patent: Nov. 12, 2024

(54) WORK MACHINE CONTROL SYSTEM, WORK MACHINE, AND WORK MACHINE CONTROL METHOD

(71) Applicant: KOMATSU LTD., Tokyo (JP)

(72) Inventor: Toru Matsuyama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 248 days.

(21) Appl. No.: 17/779,453

(22) PCT Filed: Nov. 25, 2020

(86) PCT No.: PCT/JP2020/043840
§ 371 (c)(1),
(2) Date: May 24, 2022

(87) PCT Pub. No.: WO2021/106938
PCT Pub. Date: Jun. 3, 2021

(65) Prior Publication Data

US 2022/0403617 A1 Dec. 22, 2022

(30) Foreign Application Priority Data

Nov. 27, 2019 (JP) ..... 2019-214573

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2004* (2013.01); *E02F 9/262* (2013.01)

(58) Field of Classification Search
CPC . E02F 3/435; E02F 3/32; E02F 9/2004; E02F 9/262; E02F 3/3677; E02F 3/437; E02F 3/439; E02F 9/2033; E02F 9/2041
See application file for complete search history.

(56) References Cited

U.S. PATENT DOCUMENTS

2015/0345114 A1 12/2015 Nomura et al.
2016/0237654 A1 8/2016 Arimatsu et al.
(Continued)

FOREIGN PATENT DOCUMENTS

CN 110382785 A 10/2019
EP 3 276 088 A1 1/2018
(Continued)

OTHER PUBLICATIONS

The International Search Report for the corresponding international application No. PCT/JP2020/043840, issued on Feb. 2, 2021.

*Primary Examiner* — Tyler J Lee
*Assistant Examiner* — Yufeng Zhang
(74) *Attorney, Agent, or Firm* — Global IP Counselors, LLP

(57) ABSTRACT

A distance calculation unit calculates a bucket distance that is a distance between a point on a bucket and a target design surface representing a target shape of an excavation target. An intervention control unit calculates an intervention control amount to suppress a speed of work equipment such that the bucket does not intrude on the target design surface based on the bucket distance. An attachment control unit calculates an attachment control amount to rotate the bucket around an attachment axis such that an edge of the bucket and the target design surface approach each other in a parallel state. An attachment limiting unit limits rotation of the bucket around the attachment axis such that the bucket distance is not increased by a movement of the work equipment based on the intervention control amount and the attachment control amount.

9 Claims, 10 Drawing Sheets

(51) Int. Cl.
*E02F 9/20* (2006.01)
*E02F 9/26* (2006.01)

(56) References Cited

U.S. PATENT DOCUMENTS

| | | | | |
|---|---|---|---|---|
| 2016/0251835 | A1 | 9/2016 | Kitajima et al. | |
| 2017/0284057 | A1* | 10/2017 | Moriki | E02F 9/2041 |
| 2017/0342678 | A1* | 11/2017 | Iwamura | E02F 9/2033 |
| 2017/0342679 | A1* | 11/2017 | Iwamura | E02F 9/262 |
| 2017/0342680 | A1 | 11/2017 | Iwamura et al. | |
| 2017/0342687 | A1* | 11/2017 | Iwamura | E02F 9/2033 |
| 2018/0327997 | A1 | 11/2018 | Fujii et al. | |
| 2020/0032482 | A1 | 1/2020 | Meguriya et al. | |
| 2020/0048861 | A1* | 2/2020 | Narikawa | E02F 9/20 |
| 2021/0002853 | A1 | 1/2021 | Yamashita | |

FOREIGN PATENT DOCUMENTS

| | | | |
|---|---|---|---|
| JP | 2002-30690 | A | 1/2002 |
| JP | 2014-74319 | A | 4/2014 |
| JP | 6099834 | B1 | 3/2017 |
| JP | 6099835 | B1 | 3/2017 |
| JP | 2019-173362 | A | 10/2019 |
| WO | 2015/173935 | A1 | 11/2015 |
| WO | 2015/186180 | A1 | 12/2015 |
| WO | 2016/158779 | A1 | 10/2016 |
| WO | 2016/186218 | A1 | 11/2016 |

* cited by examiner

WORK MACHINE CONTROL SYSTEM, WORK MACHINE, AND WORK MACHINE CONTROL METHOD

CROSS-REFERENCE TO RELATED APPLICATIONS

This application is a U.S. National stage application of International Application No. PCT/JP2020/043840, filed on Nov. 25, 2020. This U.S. National stage application claims priority under 35 U.S.C. § 119(a) to Japanese Patent Application No. 2019-214573, filed in Japan on Nov. 27, 2019, the entire contents of which are hereby incorporated herein by reference.

BACKGROUND INFORMATION

A tilt bucket of which the angle with respect to an operating plane of work equipment is adjustable has been known as a bucket attached to a hydraulic excavator. PCT International Publication No. WO 2016/158779 discloses a technique for automatically controlling and adjusting the tilt angle to cause the tilt bucket to be parallel to a target design surface.

SUMMARY

According to the technique disclosed in PCT International Publication No. WO 2016/158779, when the bucket intrudes on a tilt control start line separated from the target design surface by a predetermined distance, automatic tilt control is performed. When the tilt angle is adjusted by the automatic tilt control, the bucket moves in a direction away from the target design surface.

On the other hand, in a work machine such as a hydraulic excavator, intervention control is performed to automatically control work equipment such that a bucket moves along a target design surface representing a target shape of an excavation target and the bucket does not intrude on the target design surface. The intervention control controls the work equipment to decelerate according to a distance between the target design surface and the bucket. For this reason, in a case where the intervention control and automatic tilt control are simultaneously performed, when the speed where the bucket is moved away from the target design surface by the automatic tilt control is higher than the lowering speed of a boom or an arm limited by the intervention control, a control amount of the work equipment related to the intervention control may be unstable. The same applies not only to the automatic tilt control to control the tilt angle, but also to automatic rotation control to rotate the bucket around a rotation axis such that the bucket is parallel to the target design surface.

An object of the present disclosure is to provide a work machine control system, a work machine, and a work machine control method capable of simultaneously performing intervention control and automatic tilt control or automatic rotation control while maintaining the stability of operation of the work equipment.

According to a first aspect of the present invention, a control system is provided for a work machine including a boom rotatable around a boom axis, an arm rotatable around an arm axis parallel to the boom axis, and a bucket rotatable around a bucket axis parallel to the arm axis and rotatable around an attachment axis different from the bucket axis, the system including: a distance calculation unit configured to calculate a bucket distance that is a distance between a point on the bucket and a target design surface representing a target shape of an excavation target; an intervention control unit configured to calculate an intervention control amount to suppress a speed of work equipment such that the bucket does not intrude on the target design surface, based on the bucket distance; an attachment control unit configured to calculate an attachment control amount to rotate the bucket around the attachment axis such that an edge of the bucket and the target design surface approach each other in a parallel state; and an attachment limiting unit configured to limit rotation of the bucket around the attachment axis such that the bucket distance is not increased by a movement of the work equipment based on the intervention control amount and the attachment control amount.

According to the aspect, the control system for a work machine is capable of performing intervention control and automatic tilt control or automatic rotation control while maintaining the stability of operation of the work equipment.

DESCRIPTION OF EMBODIMENTS

<Coordinate System>

Figure 1:
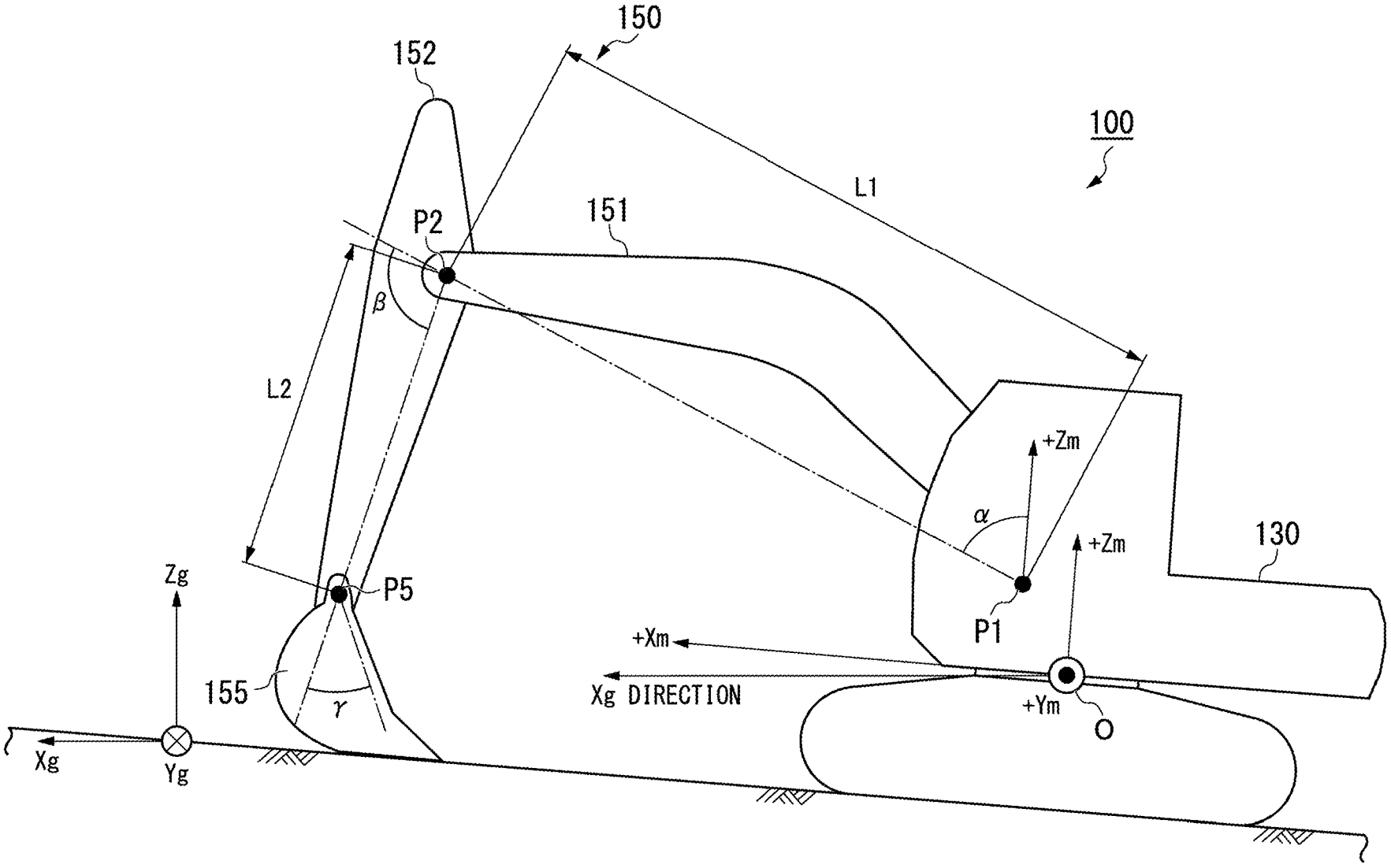
FIG. 1 is a view showing an example of a posture of a work machine and work equipment.

FIG. 1 is a view showing an example of a posture of a work machine 100 and work equipment 150.

In the following description, a three-dimensional site coordinate system (Xg, Yg, Zg) and a three-dimensional vehicle body coordinate system (Xm, Ym, Zm) are defined, and a positional relationship will be described based on these coordinate systems.

The site coordinate system is a coordinate system including an Xg axis extending north-south, a Yg axis extending east-west, and a Zg axis extending in a vertical direction with the position of a global navigation satellite system (GNSS) reference station provided at a construction site as a reference point. An exemplary example of GNSS is global positioning system (GPS). Incidentally, in another embodiment, a global coordinate system represented by latitude and longitude and the like may be used instead of the site coordinate system.

The vehicle body coordinate system is a coordinate system including an Xm axis extending front and back, a Ym axis extending left and right, and a Zm axis extending up and down with respect to a representative point O defined in a swing body 130 of the work machine 100 when viewed from a seating position of an operator in a cab 170 to be described later. With respect to the representative point O of the swing body 130, the front is referred to as a +Xm direction, the rear is referred to as a −Xm direction, the left is referred to as a +Ym direction, the right is referred to as a −Ym direction, an up direction is referred to as a +Zm direction, and a down direction is referred to as a −Zm direction.

The site coordinate system and the vehicle body coordinate system can be converted between each other by specifying a position and a tilt of the work machine 100 in the site coordinate system.

First Embodiment

«Configuration of Work Machine 100»

Figure 2:
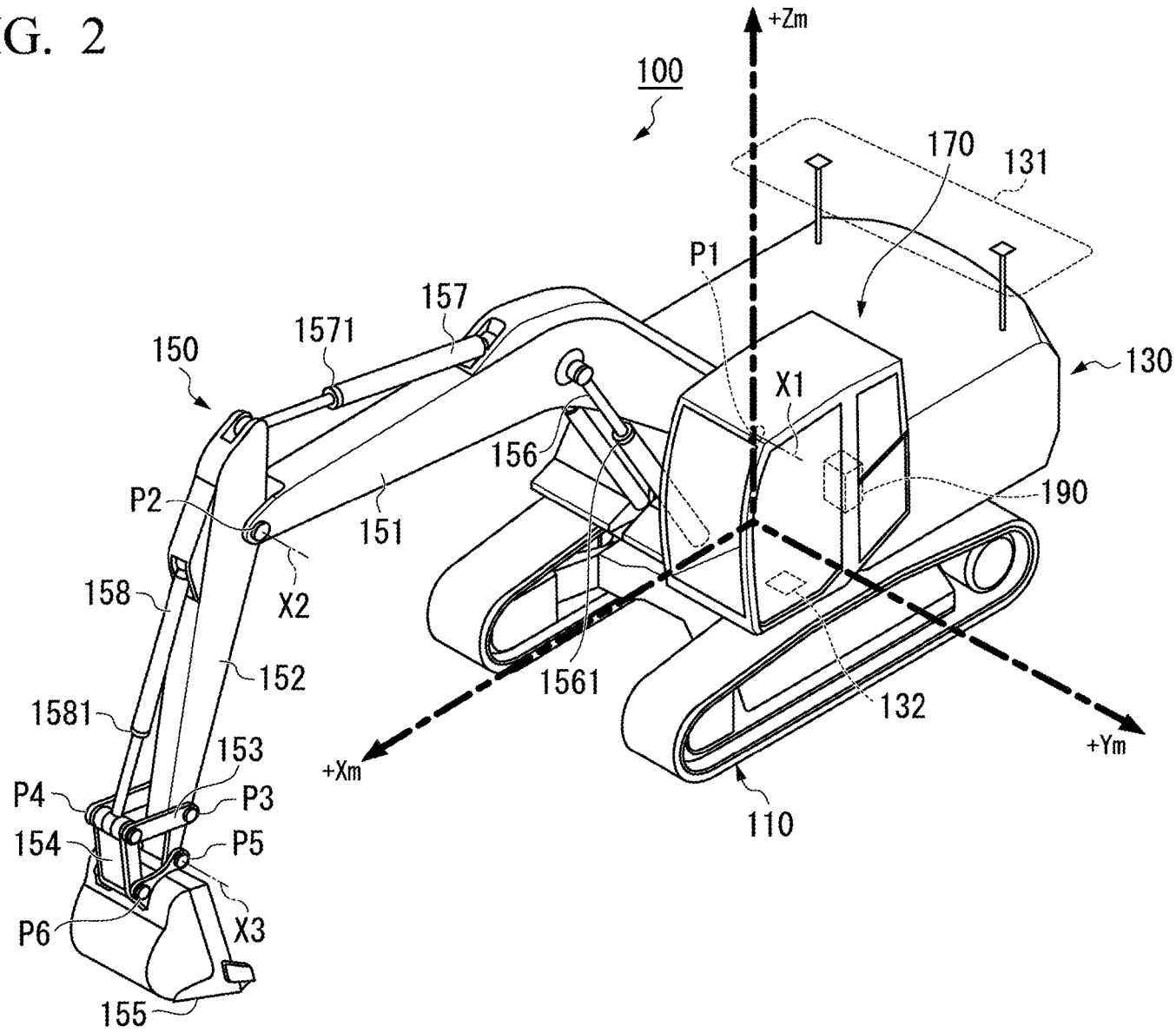
FIG. 2 is a schematic view showing a configuration of a work machine according to a first embodiment.

FIG. 2 is a schematic view showing a configuration of the work machine 100 according to a first embodiment.

The work machine 100 operates at a construction site to construct an excavation target, such as earth. The work machine 100 according to the first embodiment is a hydraulic excavator.

The work machine 100 includes an undercarriage 110, the swing body 130, the work equipment 150, the cab 170, and a control device 190.

The undercarriage 110 supports the work machine 100 so as to be capable of traveling. The undercarriage 110 is, for example, a pair of left and right endless tracks. The swing body 130 is supported by the undercarriage 110 so as to be swingable around a swing center. The work equipment 150 is driven by hydraulic pressure. The work equipment 150 is supported by a front portion of the swing body 130 so as to be drivable in an up-down direction. The cab 170 is a space in which an operator gets to operate the work machine 100. The cab 170 is provided at a front portion of the swing body 130. The control device 190 controls the undercarriage 110, the swing body 130, and the work equipment 150 based on an operation of the operator. The control device 190 is provided, for example, inside the cab 170.

«Configuration of Swing Body 130»

As shown in FIG. 2, the swing body 130 includes a position and azimuth direction detector 131 and a tilt detector 132.

The position and azimuth direction detector 131 computes a position of the swing body 130 in the site coordinate system, and an azimuth direction where the swing body 130 faces. The position and azimuth direction detector 131 includes two antennas that receive positioning signals from artificial satellites forming the GNSS. The two antennas are installed at different positions on the swing body 130. For example, the two antennas are provided in a counterweight portion of the swing body 130. The position and azimuth direction detector 131 detects a position of the representative point O of the swing body 130 in the site coordinate system based on a positioning signal received by at least one of the two antennas. The position and azimuth direction detector 131 detects an azimuth direction where the swing body 130 faces in the site coordinate system, using a positioning signal received by each of the two antennas.

The tilt detector 132 measures an acceleration and an angular speed of the swing body 130 and detects a tilt of the swing body 130 (for example, a roll representing rotation with respect to the Xm axis and a pitch representing rotation with respect to the Ym axis) based on the measurement result. The tilt detector 132 is installed, for example, below the cab 170. An exemplary example of the tilt detector 132 is an inertial measurement unit (IMU).

«Configuration of Work Equipment 150»

As shown in FIG. 2, the work equipment 150 includes a boom 151, an arm 152, a first link 153, a second link 154, and a bucket 155.

A base end portion of the boom 151 is attached to the swing body 130 via a boom pin P1. Hereinafter, a central axis of the boom pin P1 is referred to as a boom axis X1.

The arm 152 connects the boom 151 and the bucket 155. A base end portion of the arm 152 is attached to a distal end portion of the boom 151 via an arm pin P2. Hereinafter, a central axis of the arm pin P2 is referred to as an arm axis X2.

A first end of the first link 153 is attached to a side surface on a distal end side of the arm 152 via a first link pin P3. A second end of the first link 153 is attached to a first end of the second link 154 via a bucket cylinder pin P4.

The bucket 155 includes an edge that excavates earth or the like, and an accommodating portion that accommodates the excavated earth. A base end portion of the bucket 155 is attached to a distal end portion of the arm 152 via a bucket pin P5. Hereinafter, a central axis of the bucket pin P5 is referred to as a bucket axis X3. In addition, a base end portion of the bucket 155 is attached to a second end of the second link 154 via a second link pin P6.

The boom axis X1, the arm axis X2, and the bucket axis X3 are parallel to each other.

The work equipment 150 includes a plurality of hydraulic cylinders that are actuators for generating power. Specifically, the work equipment 150 includes a boom cylinder 156, an arm cylinder 157, and a bucket cylinder 158.

The boom cylinder 156 is a hydraulic cylinder that operates the boom 151. A base end portion of the boom cylinder 156 is attached to the swing body 130. A distal end portion of the boom cylinder 156 is attached to the boom 151. The boom cylinder 156 is provided with a boom cylinder stroke sensor 1561 that detects a stroke amount of the boom cylinder 156.

The arm cylinder 157 is a hydraulic cylinder that drives the arm 152. A base end portion of the arm cylinder 157 is attached to the boom 151. A distal end portion of the arm cylinder 157 is attached to the arm 152. The arm cylinder 157 is provided with an arm cylinder stroke sensor 1571 that detects a stroke amount of the arm cylinder 157.

The bucket cylinder 158 is a hydraulic cylinder that drives the bucket 155. A base end portion of the bucket cylinder 158 is attached to arm 152. A distal end portion of the bucket cylinder 158 is attached to the second end of the first link 153 and to the first end of the second link 154 via the second link pin P6. The bucket cylinder 158 is provided with a bucket cylinder stroke sensor 1581 that detects a stroke amount of the bucket cylinder 158.

«Configuration of Bucket 155»

Figure 3:
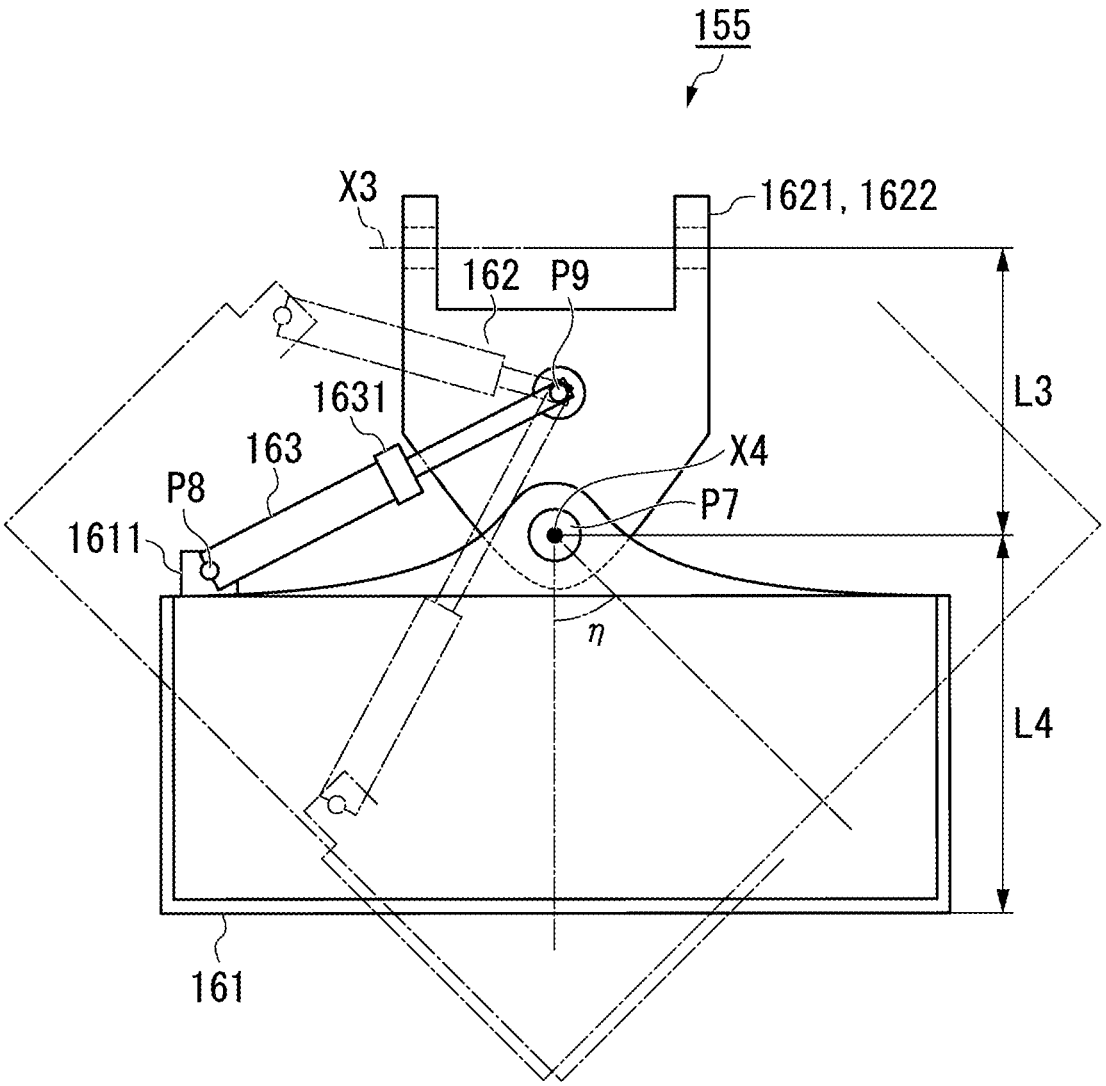
FIG. 3 is a front view showing a configuration of a bucket according to the first embodiment.

FIG. 3 is a front view showing a configuration of the bucket 155 according to the first embodiment.

The bucket 155 according to the first embodiment is a tilt bucket that is rotatable around a tilt axis X4 that is an axis orthogonal to the bucket axis X3. The tilt axis X4 is one example of an attachment axis around which the bucket 155 is rotated.

As shown in FIG. 3, the bucket 155 includes a bucket body 161, a joint 162, and a tilt cylinder 163.

A base end portion of the joint 162 is provided with a front bracket 1621 having an attachment hole for attaching the arm 152 via the bucket pin P5 and with a rear bracket 1622 having an attachment hole for attaching the second link 154 via the second link pin P6. Namely, the attachment hole of the front bracket 1621 is provided to pass through the bucket axis X3.

A distal end portion of the joint 162 is attached to a base end portion of the bucket body 161 via a tilt pin P7. The tilt pin P7 is provided to be orthogonal to the bucket axis X3. A central axis of the tilt pin P7 forms the tilt axis X4.

A tilt bracket 1611 for attaching the tilt cylinder 163 is provided at one end (left end or right end) of a base end portion of the bucket body 161.

The tilt cylinder 163 is a hydraulic cylinder that rotates the bucket body 161 around the tilt axis X4. A base end portion of the tilt cylinder 163 is attached to the tilt bracket 1611 via a tilt cylinder end pin P8. A distal end portion of the tilt cylinder 163 is attached to the joint 162 via a tilt cylinder top pin P9. The tilt cylinder end pin P8 and the tilt cylinder top pin P9 each are provided parallel to the tilt pin P7. Accordingly, the bucket body 161 is rotated around the tilt axis X4 by the driving of the tilt cylinder 163.

The tilt cylinder 163 is provided with a tilt cylinder stroke sensor 1631 that detects a stroke amount of the tilt cylinder 163.

«Configuration of Cab 170»

Figure 4:
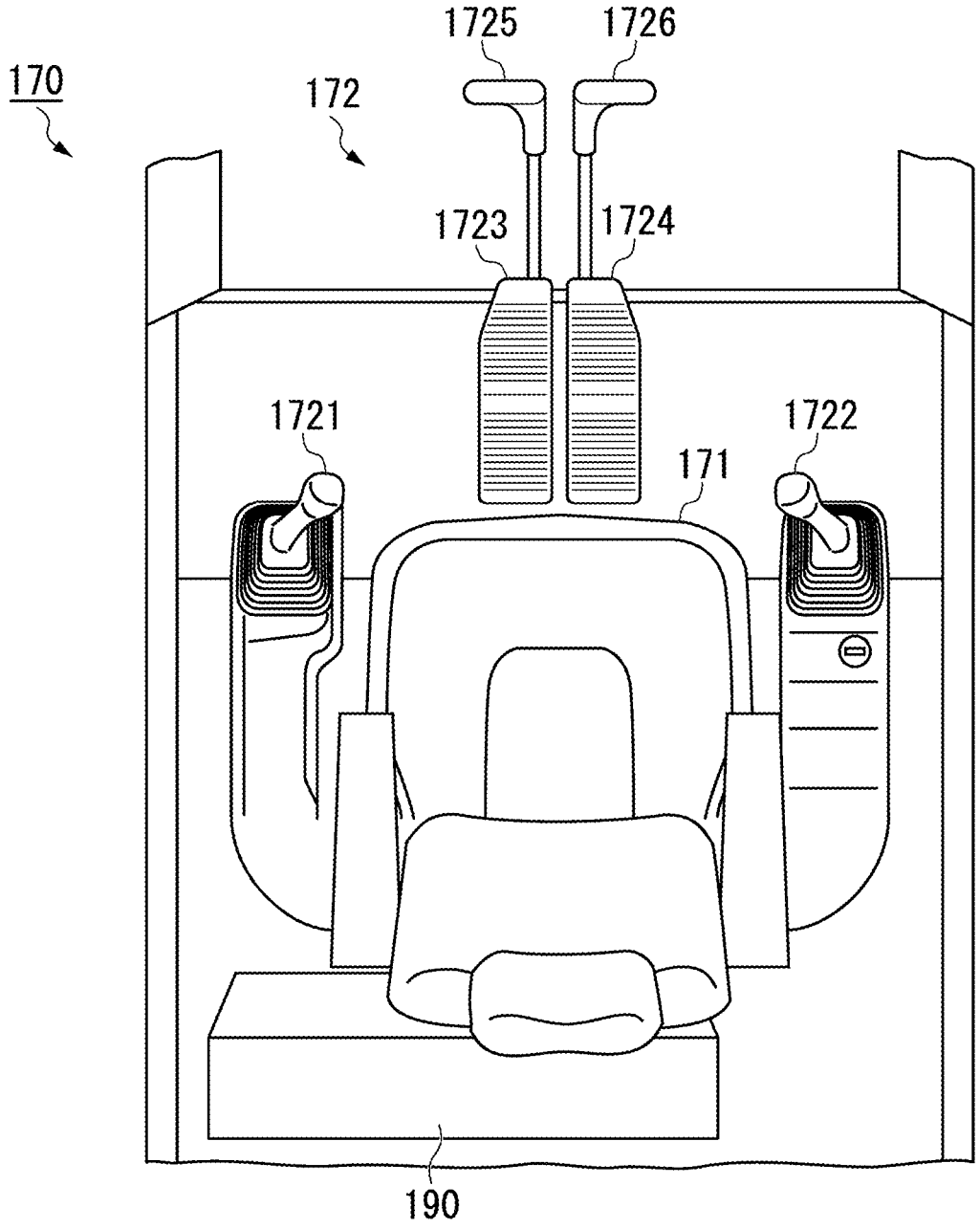
FIG. 4 is a view showing an internal configuration of a cab according to the first embodiment.

FIG. 4 is a view showing an internal configuration of the cab according to the first embodiment.

As shown in FIG. 4, a driver seat 171, an operation device 172, and the control device 190 are provided inside the cab 170.

The operation device 172 is an interface through which the undercarriage 110, the swing body 130, and the work equipment 150 are driven by a manual operation of the operator. The operation device 172 includes a left operation lever 1721, a right operation lever 1722, a left foot pedal 1723, a right foot pedal 1724, a left traveling lever 1725, and a right traveling lever 1726.

The left operation lever 1721 is provided on a left side of the driver seat 171. The right operation lever 1722 is provided on a right side of the driver seat 171.

The left operation lever 1721 is an operation mechanism that causes the swing body 130 to make a swing movement and causes the arm 152 to make a pulling movement and a pushing movement. Specifically, when the operator tilts the left operation lever 1721 forward, the arm cylinder 157 is driven and the arm 152 is pushed. In addition, when the operator tilts the left operation lever 1721 backward, the arm cylinder 157 is driven and the arm 152 is pulled. In addition, when the operator tilts the left operation lever 1721 in a right direction, the swing body 130 swings rightward. In addition, when the operator tilts the left operation lever 1721 in a left direction, the swing body 130 swings leftward.

The right operation lever 1722 is an operation mechanism that causes the bucket 155 to make an excavating movement and a dumping movement and causes the boom 151 to make a rising movement and a lowering movement. Specifically, when the operator tilts the right operation lever 1722 forward, the boom cylinder 156 is driven to cause the boom 151 to make a lowering movement. In addition, when the operator tilts the right operation lever 1722 backward, the boom cylinder 156 is driven to cause the boom 151 to make a rising movement. In addition, when the operator tilts the right operation lever 1722 in the right direction, the bucket cylinder 158 is driven to cause the bucket 155 to make a dumping movement. In addition, when the operator tilts the right operation lever 1722 in the left direction, the bucket cylinder 158 is driven to cause the bucket 155 to make an excavating movement.

Incidentally, a relationship between operating directions of the left operation lever 1721 and the right operation lever 1722, a movement direction of the work equipment 150, and a swing direction of the swing body 130 may not be the above-described relationship.

In addition, a tilt operation button (not shown) is provided at an upper portion of the right operation lever 1722. Specifically, when the operator slides the tilt operation button in the left direction, the tilt cylinder 163 is driven and the bucket 155 is tilted and rotated in the left direction when viewed from the operator. When the operator slides the tilt operation button in the right direction, the tilt cylinder 163 is driven and the bucket 155 is tilted and rotated in the right direction when viewed from the operator. Incidentally, the tilt operation button may be configured to be rotated in a left-right direction. In addition, a tilt operation may be realized by operation of a pedal (not shown) performed by the operator.

The left foot pedal 1723 is disposed on a left side of a floor surface in front of the driver seat 171. The right foot pedal 1724 is disposed on a right side of the floor surface in front of the driver seat 171. The left traveling lever 1725 is pivotally supported by the left foot pedal 1723 and is configured such that the tilt of the left traveling lever 1725 and the press down of the left foot pedal 1723 are linked to each other. The right traveling lever 1726 is pivotally supported by the right foot pedal 1724 and is configured such that the tilt of the right traveling lever 1726 and the press down of the right foot pedal 1724 are linked to each other.

The left foot pedal 1723 and the left traveling lever 1725 correspond to rotational drive of a left crawler belt of the undercarriage 110. Specifically, in a case where drive wheels of the undercarriage 110 are disposed at the rear, when the operator tilts the left foot pedal 1723 or the left traveling lever 1725 forward, the left crawler belt rotates in a forward direction. In addition, when the operator tilts the left foot pedal 1723 or the left traveling lever 1725 backward, the left crawler belt rotates in a backward direction.

The right foot pedal 1724 and the right traveling lever 1726 correspond to rotational drive of a right crawler belt of the undercarriage 110. Specifically, in a case where the drive wheels of the undercarriage 110 are disposed at the rear, when the operator tilts the right foot pedal 1724 or the right traveling lever 1726 forward, the right crawler belt rotates in the forward direction. In addition, when the operator tilts the right foot pedal 1724 or the right traveling lever 1726 backward, the right crawler belt rotates in the backward direction.

«Configuration of Control Device 190»

The control device 190 limits movement of the bucket 155 in a direction toward an excavation target such that the bucket 155 does not intrude on a target design surface set at the construction site. The target design surface represents the target shape of the excavation target. Limitation of the movement of the bucket 155 by the control device 190 based on the target design surface is also referred to as intervention control.

Here, a stop control will be described that is an intervention control in which the operator performs a lowering operation of the boom 151 to stop the edge of the bucket 155 on the target design surface. When the distance between the bucket 155 and the target design surface is less than a predetermined stop control distance, the control device 190 calculates a stop control amount to correct an operation amount of the boom 151 according to a distance between the edge of the bucket 155 and the target design surface that is involved in a movement of the boom 151 in a lowering direction, such that the bucket 155 does not intrude on the target design surface. Accordingly, the operator simply operates the boom 151 to cause the control device 190 to correct an operation amount of the boom cylinder 156, so that the movement of the bucket 155 is limited and the edge of the bucket 155 is automatically prevented from intruding on the design surface.

Incidentally, in another embodiment, the control device 190 may correct an operation amount of the arm 152 or the bucket 155 in the stop control. In addition, in another embodiment, when the operator performs operation of the arm 152, in addition to the stop control or instead of the stop control, the control device 190 may perform intervention control by moving the boom 151 in a rising direction such that the edge of the bucket 155 does not intrude on the target design surface.

In addition, when the distance between the bucket 155 and the target design surface is less than a predetermined tilt control distance, the control device 190 causes the bucket 155 to rotate around the tilt axis X4 such that the edge of the bucket 155 and the target design surface are parallel to each other. Control in which the control device 190 causes the bucket 155 to rotate around the tilt axis X4 based on the target design surface is also referred to as automatic tilt control.

Figure 5:
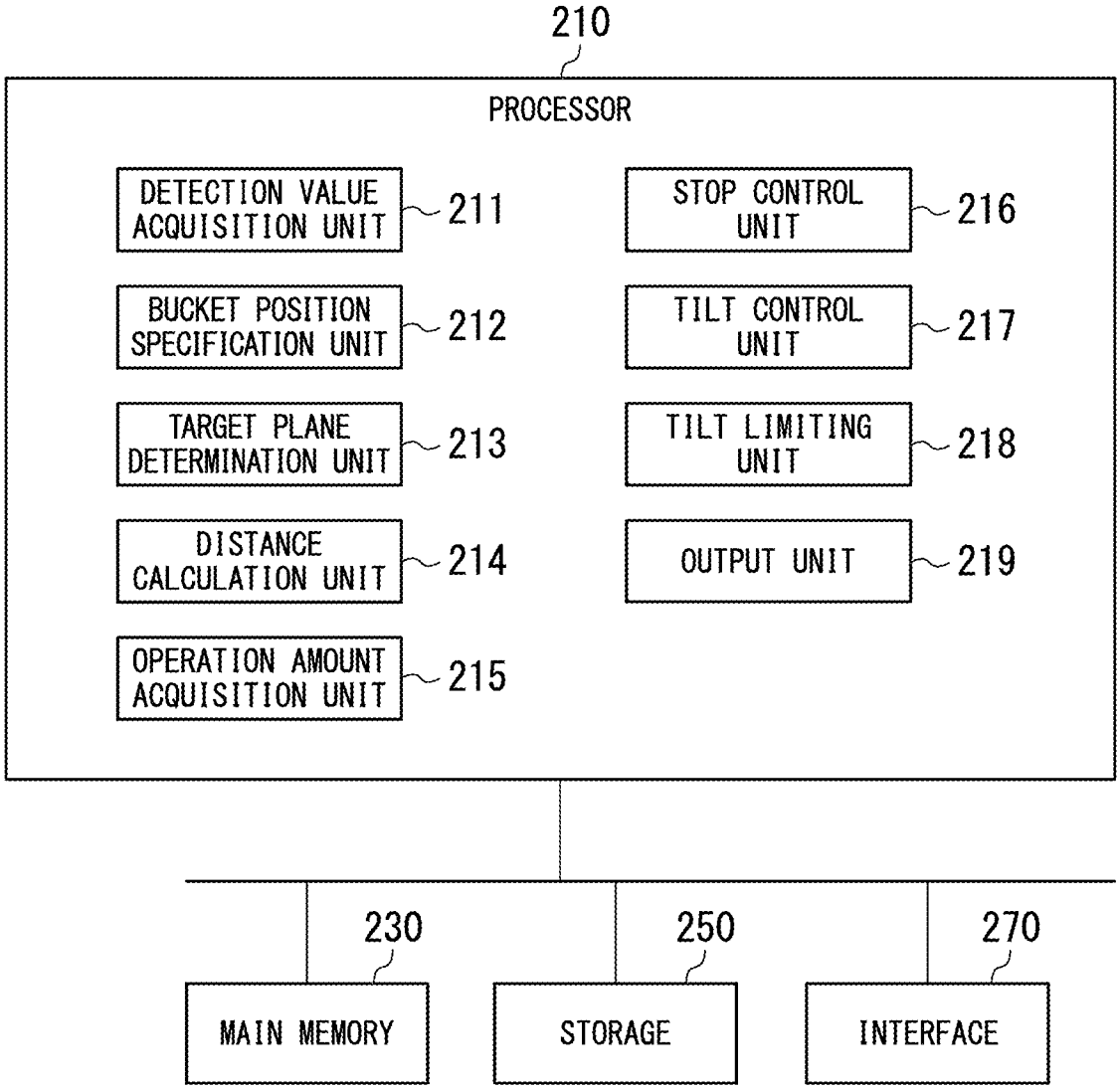
FIG. 5 is a schematic block diagram showing a configuration of a control device according to the first embodiment.

FIG. 5 is a schematic block diagram showing a configuration of the control device 190 according to the first embodiment.

The control device 190 is a computer including a processor 210, a main memory 230, a storage 250, and an interface 270.

The storage 250 is a non-transitory physical storage medium. Exemplary examples of the storage 250 include magnetic disks, optical disks, magneto-optical disks, semiconductor memories, and the like. The storage 250 may be an internal medium that is directly connected to a bus of the control device 190 or may be an external medium connected to the control device 190 via the interface 270 or via a communication line. The storage 250 stores a program for controlling the work machine 100.

The program may realize some of functions to be exhibited by the control device 190. For example, the program may exhibit functions in combination with another program that is already stored in the storage 250 or in combination with another program installed in another device. Incidentally, in another embodiment, the control device 190 may include a custom large scale integrated circuit (LSI) such as a programmable logic device (PLD) in addition to the above configuration or instead of the above configuration. Exemplary examples of the PLD include a programmable array logic (PAL), a generic array logic (GAL), a complex programmable logic device (CPLD), and a field programmable gate array (FPGA). In this case, some or all of the functions to be realized by the processor may be realized by the integrated circuit.

Design surface data indicating the target design surface is stored in the storage 250 in advance. The design surface data is three-dimensional data represented by the site coordinate system and is represented by a plurality of triangular polygons. The triangular polygons forming the design surface data have sides shared with other triangular polygons adjacent thereto. Namely, the design surface data represents a continuous plane formed of a plurality of planes. Incidentally, in another embodiment, the design surface data may be formed of polygonal surfaces other than triangular polygons or may be represented in another format, such as point cloud data.

Incidentally, in the present embodiment, the design surface data is stored in the storage 250, but the present invention is not limited to this configuration. The design surface data may be downloaded from an external memory or a server (not shown) via a communication line (not shown).

The processor 210 executes the program to function as a detection value acquisition unit 211, a bucket position specification unit 212, a target plane determination unit 213, a distance calculation unit 214, an operation amount acquisition unit 215, a stop control unit 216, a tilt control unit 217, a tilt limiting unit 218, and an output unit 219.

The detection value acquisition unit 211 acquires a detection value of each of the boom cylinder stroke sensor 1561, the arm cylinder stroke sensor 1571, the bucket cylinder stroke sensor 1581, the tilt cylinder stroke sensor 1631, the position and azimuth direction detector 131, and the tilt detector 132. Namely, the detection value acquisition unit 211 acquires a position of the swing body 130 in the site coordinate system, an azimuth direction where the swing body 130 faces, a tilt of the swing body 130, a stroke length of the boom cylinder 156, a stroke length of the arm cylinder 157, a stroke length of the bucket cylinder 158, and a stroke length of the tilt cylinder 163.

The bucket position specification unit 212 specifies positions of a plurality of points on the edge of the bucket 155 based on the detection values acquired by the detection value acquisition unit 211. For example, the bucket position specification unit 212 specifies positions of five points that divide the edge of the bucket 155 into four equal segments. A method for specifying a position of the edge of the bucket 155 will be described later.

The target plane determination unit 213 determines a target plane that is a target of the stop control and of tilt control. The target plane is a plane passing through at least one of the plurality of triangular polygons forming the target design surface. Specifically, the target plane determination unit 213 determines the target plane according to the following procedure. The target plane determination unit 213 calculates a distance between each point of the plurality of points and a triangular polygon facing each point among the triangular polygons forming the target design surface, based on the design surface data and the positions of the plurality of points specified by the bucket position specification unit 212. At this time, the plurality of points may face different triangular polygons. The target plane determination unit 213 specifies a triangular polygon related to a shortest distance, and determines a plane passing through the triangular polygon, as the target plane.

The distance calculation unit 214 calculates distances between the plurality of points and the target plane based on the positions of the plurality of points specified by the bucket position specification unit 212 and the target plane determined by the target plane determination unit 213.

The operation amount acquisition unit 215 acquires an operation signal indicating an operation amount from the operation device 172. The operation amount acquisition unit 215 acquires at least an operation amount related to a rising operation and a lowering operation of the boom 151, an operation amount related to a pushing operation and a pulling operation of the arm 152, and an operation amount related to an excavating operation, a dumping operation, and a tilt operation of the bucket 155.

The stop control unit 216 performs the stop control of the work equipment 150 based on the operation amount of the operation device 172 acquired by the operation amount acquisition unit 215 and the shortest distance (shortest bucket distance) among the distances calculated by the distance calculation unit 214. Specifically, the stop control unit 216 calculates a stop control amount according to the following procedure. An allowable speed of the bucket 155 is calculated by substituting the shortest bucket distance calculated by the distance calculation unit 214 into an allowable speed function for obtaining an allowable speed from a distance between the bucket 155 and the target plane. Incidentally, according to the allowable speed function, the allowable speed increases monotonically with the distance between the bucket and the target plane. "Monotonically increase" means that when one value increases, the other value always increases or does not change (monotonic non-decrease). The stop control unit 216 calculates the allowable speed as a stop control amount. The stop control unit 216 is one example of an intervention control unit that calculates an intervention control amount to suppress the speed of the work equipment such that the bucket 155 does not intrude on the target design surface. The stop control amount is one example of the intervention control amount.

The tilt control unit 217 performs the automatic tilt control based on a difference between a first distance that is a distance from a left end of the edge of the bucket 155 to the target plane and a second distance that is a distance from a right end of the edge of the bucket 155 to the target plane, among the distances calculated by the distance calculation unit 214. The left end and the right end of the edge of the bucket 155 are one example of a first bucket point and of a second bucket point. Incidentally, in another embodiment, the first bucket point and the second bucket point may be other points on the bucket 155. However, the condition that the second bucket point exists on a straight line passing through the first bucket point and parallel to the edge of the bucket 155 has to be satisfied. Namely, in another embodiment, the first bucket point and the second bucket point may not necessarily be points on the edge, such as points on a bottom surface. The tilt control unit 217 is one example of an attachment control unit.

The tilt limiting unit 218 cancels the automatic tilt control performed by the tilt control unit 217 when the difference between the first distance and the second distance is more than a predetermined length threshold value. Namely, the tilt limiting unit 218 does not perform the automatic tilt control when an angle between the edge of the bucket 155 and the target design surface exceeds a predetermined range. Incidentally, the predetermined length threshold value is calculated based on an automatic tilt control amount determined from the difference between the first distance and the second distance and the intervention control amount. Namely, the tilt limiting unit 218 calculates the predetermined length threshold value from the allowable speed.

The tilt limiting unit 218 is one example of an attachment limiting unit that limits rotation around the attachment axis such that the shortest bucket distance is not increased.

The output unit 219 outputs a control signal to each actuator based on the operation amount acquired by the operation amount acquisition unit 215, the stop control amount calculated by the stop control unit 216, and the tilt control amount calculated by the tilt control unit 217.

«Method for Specifying Position of Edge of Bucket 155»

Here, a method for specifying a position of the edge of the bucket 155 using the bucket position specification unit 212 will be described with reference to FIGS. 1 and 3. A position of the edge of the bucket 155 in the vehicle body coordinate system can be specified by a boom length L1, an arm length L2, a joint length L3, a bucket length L4, a boom relative angle $\alpha$, an arm relative angle $\beta$, a bucket relative angle $\gamma$, a tilt angle $\eta$, a position of the boom pin P1 in the vehicle body coordinate system, and a position of the representative point O in the site coordinate system.

The boom length L1 is a known length from the boom pin P1 to the arm pin P2.

The arm length L2 is a known length from the arm pin P2 to the first link pin P3.

The joint length L3 is a known length from the first link pin P3 to the tilt pin P7.

The bucket length L4 is a known length from the tilt pin P7 to a center point of the edge of the bucket 155.

The boom relative angle $\alpha$ is represented by an angle formed by a half line extending from the boom pin P1 in the up direction (+Zm direction) of the swing body 130 and a half line extending from the boom pin P1 to the arm pin P2. Incidentally, as shown in FIG. 1, the up direction (+Zm direction) of and a vertical up direction (+Zg direction) of the swing body 130 do not necessarily coincide with each other due to a tilt $\theta$ of the swing body 130.

The arm relative angle $\beta$ is represented by an angle formed by a half line extending from the boom pin P1 to the arm pin P2 and a half line extending from the arm pin P2 to the first link pin P3.

The bucket relative angle $\gamma$ is represented by an angle formed by a half line extending from the arm pin P2 to the first link pin P3 and a half line extending from the first link pin P3 to the tilt pin P7.

The tilt angle $\eta$ is represented by an angle formed by a half line extending from the tilt pin P7 in a direction orthogonal to the first link pin P3 and to the tilt pin P7 and a half line extending from the tilt pin P7 to the center point of the edge of the bucket 155.

The position of the edge of the bucket 155 in the site coordinate system is specified according to, for example, the following procedure. The bucket position specification unit 212 specifies the position of the arm pin P2 in the vehicle body coordinate system based on the position of the boom pin P1 in the vehicle body coordinate system, the boom relative angle $\alpha$, and the boom length L1. The bucket position specification unit 212 specifies the position of the first link pin P3 in the vehicle body coordinate system based on the position of the arm pin P2 in the vehicle body coordinate system, the arm relative angle $\beta$, and the arm length L2. The bucket position specification unit 212 specifies the position of the tilt pin P7 in the vehicle body coordinate system based on the position of the first link pin P3 in the vehicle body coordinate system, the bucket relative angle $\gamma$, and the joint length L3. The bucket position specification unit 212 specifies the position of the center point of the edge of the bucket 155 in the vehicle body coordinate system based on the position of the tilt pin P7 in the vehicle body coordinate system, the tilt angle $\eta$, and the bucket length L4. In addition, the bucket position specification unit 212 can specify a position of a freely-selected point on the edge by specifying a distance from the center point of the edge to the freely-selected point on the edge, and by calculating a position that is offset from the position of the center point of the edge by the distance from the center point of the edge to the random point in a direction of the tilt angle $\eta$. For example, the bucket position specification unit 212 can specify positions of both ends of the edge by calculating positions that are offset from the position of the center point of the edge by ½ the length of the edge in a width direction in positive and negative directions of the tilt angle η.

The boom relative angle α, the arm relative angle β, the bucket relative angle γ, and the tilt angle η are specified by the detection value of the boom cylinder stroke sensor 1561, the detection value of the arm cylinder stroke sensor 1571, the detection value of the bucket cylinder stroke sensor 1581, and the detection value of the tilt cylinder stroke sensor 1631. The bucket position specification unit 212 converts the position of the edge of the bucket 155 in the vehicle body coordinate system into a position in the site coordinate system based on the position of the swing body 130 in the site coordinate system, the azimuth direction where the swing body 130 faces, and the posture of the swing body 130.

Incidentally, the detection of the boom relative angle α, the arm relative angle β, the bucket relative angle γ, and the tilt angle η is not limited to being performed by the cylinder stroke sensors, and may be performed by angle sensors.

«Operation of Control Device 190»

Figure 6:
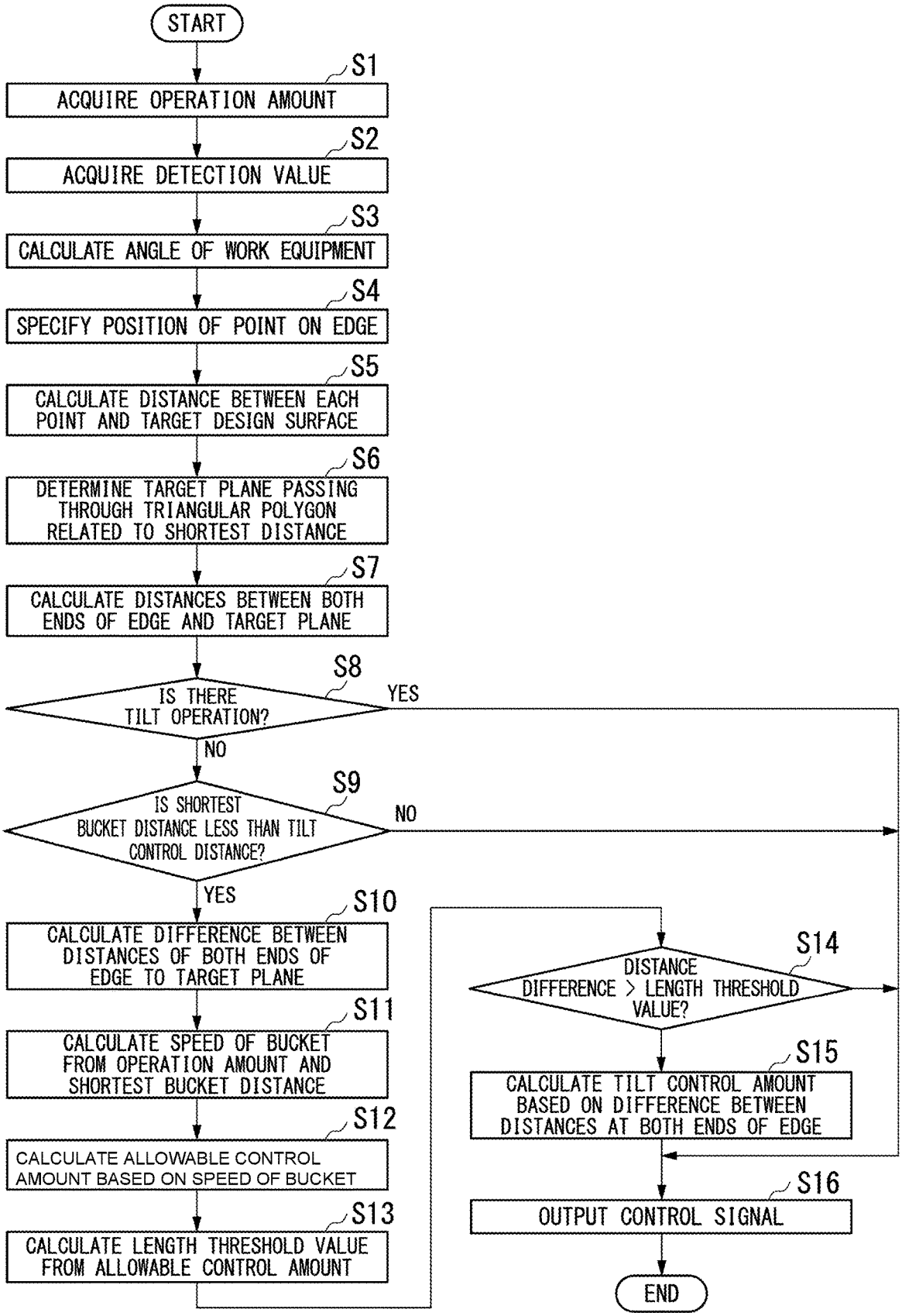
FIG. 6 is a flowchart showing operation of the control device according to the first embodiment.
Figure 7:
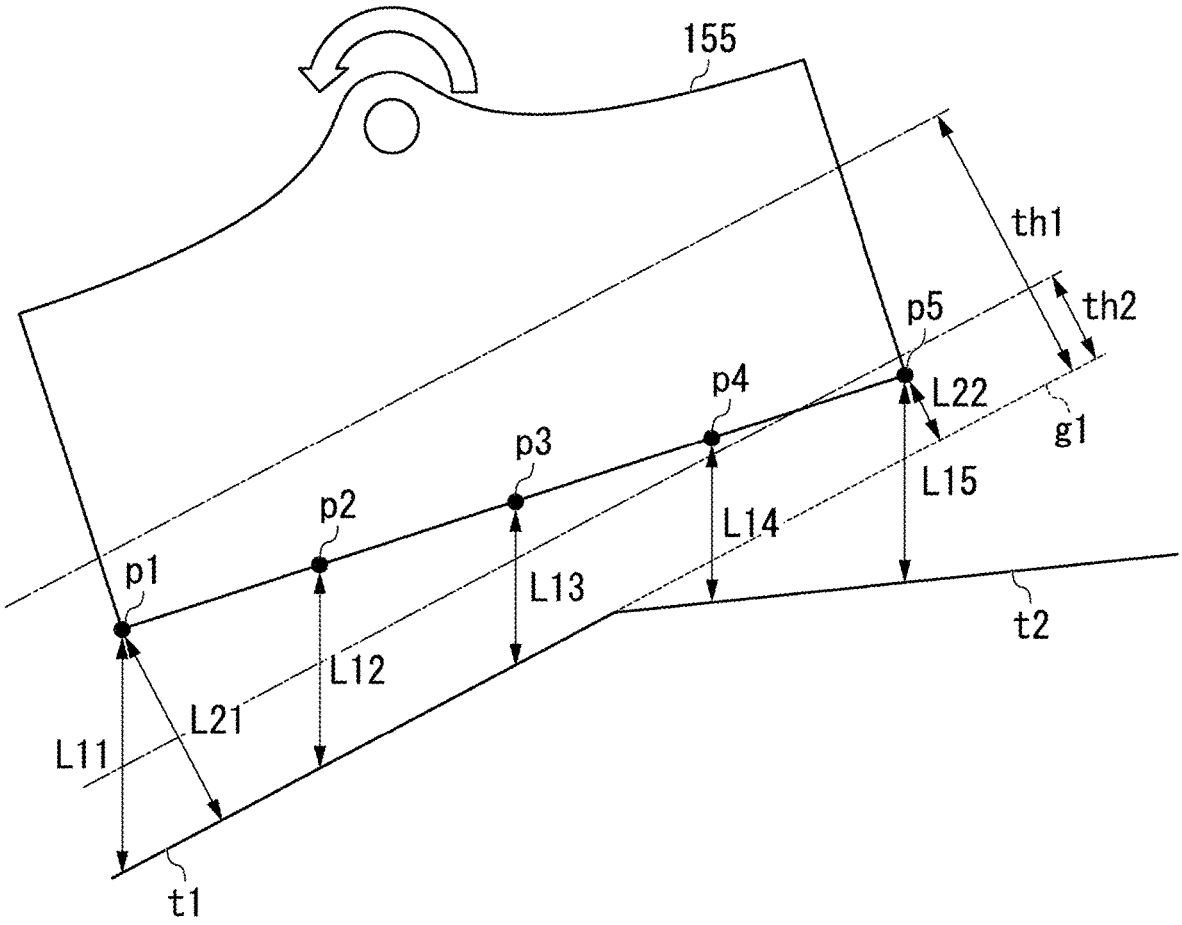
FIG. 7 is a view showing a relationship between a target design surface and a point on an edge in automatic tilt control.

FIG. 6 is a flowchart showing operation of the control device 190 according to the first embodiment. FIG. 7 is a view showing a relationship between the target design surface and a point on the edge in the automatic tilt control.

When the operator of the work machine 100 starts operation of the work machine 100, the control device 190 executes the following controls at predetermined control cycles.

The operation amount acquisition unit 215 acquires an operation amount related to the boom 151, an operation amount related to the arm 152, an operation amount related to the bucket 155, an operation amount related to tilt, and an operation amount related to the swing of the swing body 130 from the operation device 172 (step S1). The detection value acquisition unit 211 acquires information detected by each of the position and azimuth direction detector 131, the tilt detector 132, the boom cylinder stroke sensor 1561, the arm cylinder stroke sensor 1571, the bucket cylinder stroke sensor 1581, and the tilt cylinder stroke sensor 1631 (step S2).

The bucket position specification unit 212 calculates the boom relative angle α, the arm relative angle β, the bucket relative angle γ, and the tilt angle η from a stroke length of each of the hydraulic cylinders (step S3). In addition, the bucket position specification unit 212 calculates positions of five points in the site coordinate system that divide the edge of the bucket 155 into four equal segments, based on the detection values acquired in step S2, the angles calculated in step S3, and the known length parameters of the work equipment 150 (step S4). Hereinafter, the five points on the edge of the bucket 155 are referred to as a point p1, a point p2, a point p3, a point p4, and a point p5 in order from the left end of the edge. Namely, the point p1 is a point at the left end of the edge, the point p5 is a point at the right end of the edge, and the point p3 is the center point of the edge.

Incidentally, when angles are directly detected using angle sensors or IMUs, step S3 may be omitted.

The target plane determination unit 213 reads out the design surface data from the storage 250 and calculates a distance between each of the points p1 to p5 and the target design surface (step S5). In step S5, the target plane determination unit 213 calculates a distance between each point of the points p1 to p5 and a triangular polygon facing each point in a direction extending from the each point in the vertical direction (Zg-axis direction). In the example shown in FIG. 7, the target plane determination unit 213 calculates distances L11 to L13 between the points p1 to p3 and a triangular polygon t1 and distances L14 and L15 between the points p4 and p5 and a triangular polygon t2. When a position of the edge of the bucket 155 is specified in the site coordinate system, the design surface data based on the site coordinate system is used. When a position of the edge of the bucket 155 is specified in the vehicle body coordinate system, design surface data based on the vehicle body coordinate system may be used. For example, the design surface data based on the vehicle body coordinate system may be obtained by converting the design surface data based on the site coordinate system into data in the vehicle body coordinate system based on the detection values of the position and azimuth direction detector 131 and of the tilt detector 132.

Next, the target plane determination unit 213 specifies a triangular polygon related to the shortest distance, and determines a plane passing through the triangular polygon, as the target plane g1 (step S6). In the example shown in FIG. 7, since the distance L13 between the point p3 and the triangular polygon t1 is the shortest distance among the distances L11 to L15, the target plane determination unit 213 determines a plane passing through the triangular polygon t1, as a target plane g1.

The distance calculation unit 214 calculates a distance L21 between the point p1 and the target plane g1 and a distance L22 between the point p5 and the target plane g1 based on the positions of the points p1 and p5 at both ends of the edge calculated in step S4 and the target plane g1 determined in step S6 (step S7). In step S7, the target plane determination unit 213 calculates the distances L21 and L22 between the points p1 and p5 and the target plane g1 in a normal direction of the target plane g1. The distance calculation unit 214 specifies a shorter one of the distance L21 and the distance L22 as a shortest bucket distance.

Next, the tilt control unit 217 determines whether or not there is a tilt operation input by the operator, based on the operation amounts acquired in step S1 (step S8). For example, when an absolute value of the tilt operation amount is less than a predetermined value, the tilt control unit 217 determines that there is no operation input. When there is no tilt operation (step S8: NO), the tilt control unit 217 determines whether or not the shortest bucket distance specified in step S7 is less than a tilt control distance th2 (step S9).

When the shortest bucket distance is less than the tilt control distance th2 (step S9: YES), the tilt control unit 217 calculates a difference between the distance L21 and the distance L22 (distance difference) calculated in step S7 (step S10).

The stop control unit 216 calculates a speed of the bucket 155 based on the shortest bucket distance specified in step S7 and the operation amounts acquired in step S1 (step S11). Specifically, the stop control unit 216 substitutes the shortest bucket distance into the allowable speed function to calculate an allowable speed of the bucket 155. In addition, the stop control unit 216 calculates a speed (non-intervention speed) of the bucket 155 when the work equipment 150 is controlled according to the operation amounts acquired in step S1, based on the operation amounts. The stop control unit 216 sets a slower one of the allowable speed and the non-intervention speed as the speed of the bucket 155.

The tilt limiting unit 218 determines an allowable control amount related to the rotation of the bucket 155 around the tilt axis X4 based on the speed of the bucket 155 calculated in step S11 (step S12). Incidentally, the tilt limiting unit 218 determines the allowable control amount to a smaller value as the speed of the bucket 155 is slower.

The tilt limiting unit 218 calculates a predetermined length threshold value from the allowable control amount (step S13). The predetermined length threshold value is set to a smaller value as the allowable control amount is smaller.

Here, the tilt limiting unit 218 determines whether or not the distance difference calculated in step S10 is more than the predetermined length threshold value calculated in step S13 (step S14). When the distance difference is not more than the predetermined length threshold value (step S14: NO), the tilt control unit 217 calculates a tilt control amount based on the distance difference calculated in step S10 (step S15).

Figure 8:
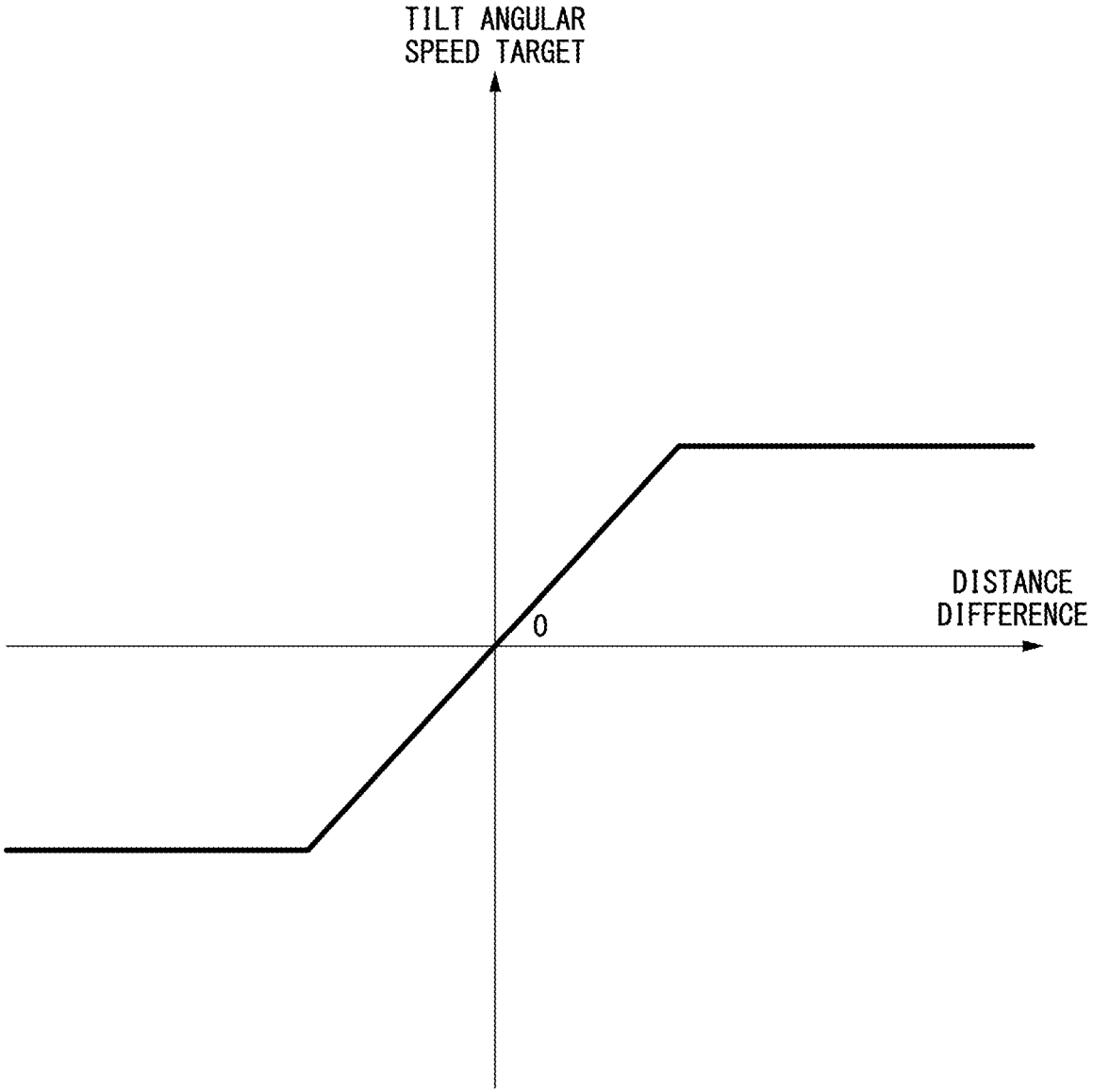
FIG. 8 is a view showing an example of a tilt function showing a relationship between a bucket distance difference and a target value of a tilt angular speed according to the first embodiment.

FIG. 8 is a view showing an example of a tilt function showing a relationship between a distance difference of the bucket and a target value of a tilt angular speed according to the first embodiment. The distance difference of the bucket shown in FIG. 8 is obtained by subtracting the distance L22 from the distance L21 shown in FIG. 7, and the counter-clockwise angular speed in FIG. 7 is positive.

In step S15, the tilt control unit 217 substitutes the distance difference into the tilt function determined in advance as shown in FIG. 8 to determine a target value of a tilt angular speed. The tilt function is a function for obtaining a target value of the tilt angular speed based on the distance difference of the bucket 155. In the tilt function, the target value of the tilt angular speed increases monotonically with the distance difference of the bucket 155. In addition, in the tilt function, an upper limit value and a lower limit value of the tilt angular speed are determined, and when an absolute value of the distance difference is more than a predetermined value, the target value of the tilt angular speed is constant. Then, the tilt control unit 217 determines a tilt control amount based on the determined target value of the tilt angular speed.

Incidentally, when a tilt operation is performed (step S8: YES) and when both the distance L21 and the distance L22 are the tilt control distance th2 or more (step S9: NO), the tilt control unit 217 does not calculate the tilt control amount. In addition, in step S16, when the distance difference is more than the predetermined length threshold value (step S14: YES), the tilt limiting unit 218 cancels the automatic tilt control of the tilt control unit 217. At this time, the control device 190 may notify the operator that the automatic tilt control is not performed, by display, sound, or the like.

Then, the output unit 219 outputs a control signal to each actuator based on each operation amount related to the work equipment 150 and the tilt control amount calculated by the tilt control unit 217 (step S16). When the automatic tilt control is executed, the tilt cylinder 163 is driven according to the signal generated by the tilt control unit 217. When the automatic tilt control is not executed, the tilt cylinder 163 is driven according to a signal based on the operator operation amount.

As described above, the control device 190 according to the first embodiment calculates the stop control amount such that the bucket 155 does not intrude on the target design surface, and the tilt control amount such that bring the bucket 155 and the target design surface approach each other in a parallel state. Then, the control device 190 limits rotation around the tilt axis X4 such that the shortest bucket distance is not increased by the movement of the work equipment 150, based on the stop control amount and the tilt control amount. Since a change in the shortest bucket distance decreases monotonically with time due to the limitation of rotation around the tilt axis X4, the change in the stop control amount made by the control device 190 can be stabilized. Therefore, the control device 190 can simultaneously perform the stop control and the automatic tilt control while maintaining the stability of operation of the work equipment 150.

In particular, in the case of rotation around the tilt axis X4 not being limited, when the shortest bucket distance increases near the tilt control distance, the ON and the OFF of the tilt control are repeatedly switched and thus, the movement of the work equipment 150 may be unstable. For this reason, the control device 190 limits rotation around the tilt axis X4 such that the shortest bucket distance is not increased, so that the frequent ON and OFF switching of the tilt control can be suppressed and the movement of the work equipment 150 can be stabilized.

In addition, when the difference between the distances at both ends of the edge is more than the length threshold value, namely, when the angle between the edge of the bucket 155 and the target design surface exceeds the predetermined range, the control device 190 according to the first embodiment stops rotation around the tilt axis X4 to limit the rotation around the tilt axis X4 such that the shortest bucket distance is not increased. In the first embodiment, the larger the angle between the edge of the bucket 155 and the target design surface is, the larger the tilt control amount is. For this reason, the length threshold value is set within a range where the rising speed of the lowest point of the bucket 155 by the tilt control is not more than the allowable speed of the work equipment 150 by the stop control, so that rotation around the tilt axis X4 can be limited such that the shortest bucket distance is not increased.

Incidentally, in the first embodiment, the automatic tilt control is not performed when the angle between the edge of the bucket 155 and the target design surface exceeds the predetermined range, but it is possible to enable the automatic tilt control by bringing the tilt angle $\eta$ of the bucket 155 close to the target design surface by an operation of the operator and setting the difference between the distances at the both ends of the edge to the length threshold value or less.

Second Embodiment

The control device 190 according to the first embodiment cancels the automatic tilt control when the angle between the edge of the bucket 155 and the target design surface exceeds the predetermined range. On the other hand, the control device 190 according to a second embodiment changes the tilt function according to the allowable speed of the work equipment 150 to limit rotation around the tilt axis X4 such that the shortest bucket distance is not increased.

The control device 190 according to the second embodiment has the same configuration as that of the first embodiment as shown in FIG. 5. On the other hand, the control device 190 according to the second embodiment is different from that of the first embodiment in operation of the tilt limiting unit 218.

The tilt limiting unit 218 according to the second embodiment changes a tilt related to the tilt function according to an allowable speed calculated by the stop control unit 216. Specifically, the tilt limiting unit 218 changes the tilt related to the tilt function (gain related to the distance difference) such that the lower the allowable speed calculated by the stop control unit 216 is, the smaller the target value of the tilt angular speed with respect to the difference between the distances at both ends of the edge of the bucket 155 is. A relationship between the allowable speed and the tilt related to the tilt function is determined in advance. Incidentally, the tilt related to the tilt function is determined such that the moving speed of the lowest point of the bucket 155 is not more than the allowable speed when the bucket 155 is rotated according to the target value of the tilt angular speed.

«Operation of Control Device 190»

Figure 9:
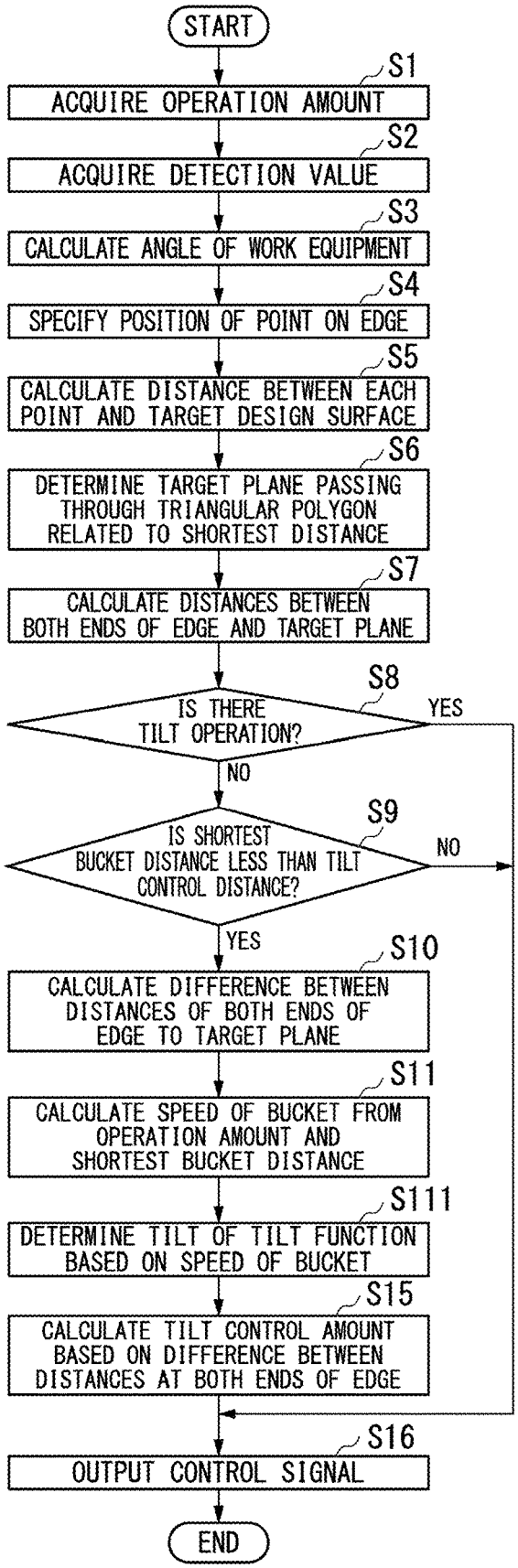
FIG. 9 is a flowchart showing operation of a control device according to a second embodiment.

FIG. 9 is a flowchart showing operation of the control device 190 according to the second embodiment.

Similarly to the first embodiment, the control device 190 performs the processes from step S1 to step S11. When the stop control unit 216 calculates a speed of the bucket 155 based on the operation amounts and the shortest bucket distance in step S11, the tilt limiting unit 218 determines a tilt of the tilt function based on the speed of the bucket 155 calculated in step S11 (step S111). In other words, the tilt limiting unit 218 specifies a tilt corresponding to the speed of the bucket 155 calculated in step S11 from a relationship between the speed of the bucket 155 determined in advance and the tilt related to the tilt function. Then, the tilt control unit 217 substitutes the distance difference calculated in step S10 into the tilt function determined in step S111 (step S15) to calculate a tilt control amount. Thereafter, similarly to the first embodiment, the control device 190 performs the process of step S16.

As described above, the control device 190 according to the second embodiment changes the tilt function according to the speed of the bucket 155. Accordingly, the lower the speed of the bucket 155 is, the smaller the target value of the tilt angular speed is, so that rotation around the tilt axis X4 can be limited such that the shortest bucket distance is not increased.

According to the second embodiment, the control device 190 can execute the automatic tilt control even when the angle between the edge of the bucket 155 and the target design surface exceeds the predetermined range.

Incidentally, the tilt limiting unit 218 according to the second embodiment changes the tilt related to the tilt function according to the allowable speed calculated by the stop control unit 216, but the present invention is not limited to this configuration. For example, the tilt limiting unit 218 according to another embodiment may change an upper limit value and a lower limit value related to the tilt function according to the allowable speed. In this case, an upper limit value and a lower limit value of a target value of the tilt angular speed are determined such that the moving speed of the lowest point of the bucket 155 is not higher than the allowable speed when the bucket 155 is rotated according to the upper limit value or the lower limit value. In another embodiment, the tilt, the upper limit value, and the lower limit value related to the tilt function may be changed according to the allowable speed calculated by the stop control unit 216.

Third Embodiment

The control device 190 according to a third embodiment calculates an allowable control amount to be able to keep the shortest bucket distance constant, based on the allowable speed, and limits the tilt control amount to the allowable control amount or less.

The control device 190 according to the third embodiment has the same configuration as that of the first embodiment as shown in FIG. 5. On the other hand, the control device 190 according to the third embodiment is different from that of the first embodiment in operation of the tilt limiting unit 218.

The tilt limiting unit 218 according to the third embodiment converts the allowable speed calculated by the stop control unit 216 into a rotation speed of the bucket 155 around the tilt axis X4 to calculate an allowable angular speed. For example, the tilt limiting unit 218 divides the allowable speed by a length from the tilt pin P7 to one end of the edge of the bucket 155, to calculate an allowable angular speed. Then, the tilt limiting unit 218 converts the allowable angular speed into a tilt control amount to calculate an allowable control amount. Then, the tilt limiting unit 218 limits the tilt control amount calculated by the tilt control unit 217 to the allowable control amount or less.

«Operation of Control Device 190»

Figure 10:
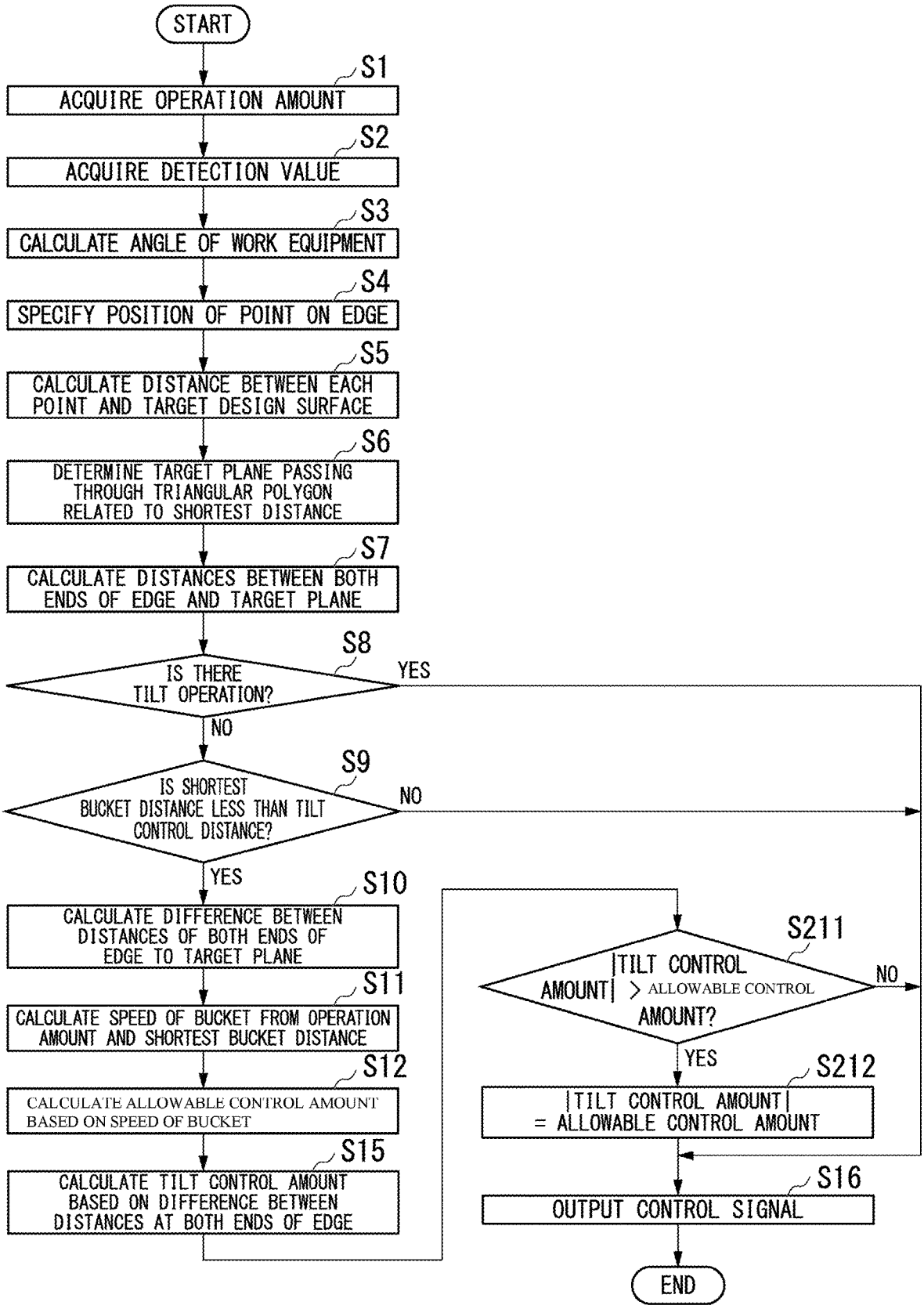
FIG. 10 is a flowchart showing operation of a control device according to a third embodiment.

FIG. 10 is a flowchart showing operation of the control device 190 according to the third embodiment.

Similarly to the first embodiment, the control device 190 performs the processes of steps S1 to S12. When the allowable control amount is calculated in step S12, the tilt control unit 217 substitutes the distance difference calculated in step S10 into the tilt function to calculate a tilt control amount (step S15).

Next, the tilt limiting unit 218 determines whether or not an absolute value of the tilt control amount calculated in step S15 is more than the allowable control amount calculated in step S12 (step S211). When the absolute value of the tilt control amount is more than the allowable control amount (step S211: YES), the tilt limiting unit 218 limits the tilt control amount such that the absolute value is equal to the allowable control amount. The tilt limiting unit 218 rewrites the absolute value of the tilt control amount into an absolute value of the allowable control amount while maintaining the sign of the tilt control amount (step S212). On the other hand, when the absolute value of the tilt control amount is the allowable control amount or less (step S211: NO), the tilt control amount is not rewritten.

Thereafter, similarly to the first embodiment, the control device 190 performs the process of step S16.

As described above, the control device 190 according to the third embodiment calculates an allowable control amount to be able to keep the shortest bucket distance constant, based on the allowable speed, and limits the absolute value of the tilt control amount to the allowable control amount or less. Accordingly, the control device 190 can limit rotation around the tilt axis X4 such that the shortest bucket distance is not increased.

Incidentally, according to the third embodiment, the control device 190 can execute the automatic tilt control even when the angle between the edge of the bucket 155 and the target design surface exceeds the predetermined range.

OTHER EMBODIMENTS

The embodiments have been described above in detail with reference to the drawings; however, the specific configurations are not limited to the above-described configurations, and various design changes and the like can be made. In another embodiment, the order of the above-described processes may be appropriately changed. In addition, some of the processes may be executed in parallel.

The control device 190 according to the above-described embodiments may be formed of a single computer, or the configurations of the control device 190 may be divided into a plurality of computers, and the plurality of computers may cooperate with each other to function as a control system. At this time, some computers forming the control device 190 may be mounted inside the work machine 100 and the other computers may be provided outside the work machine 100.

The control device 190 according to the above-described embodiments obtains the distances L11 to L15 and the distances L21 and L22 based on the reference shown in FIG.

7, but the present invention is not limited to this configuration. For example, the control device 190 according to another embodiment may obtain the distances L11 to L15 as distances with respect to a normal direction of a triangular polygon or may obtain the distances L11 to L15 as distances with respect to a direction orthogonal to the edge of the bucket 155. In addition, the control device 190 according to another embodiment may obtain the distances L21 and L22 as distances in the vertical direction or may obtain the distances L21 and L22 as distances in the direction orthogonal to the edge of the bucket 155.

The control device 190 according to the above-described embodiments performs the stop control and the automatic tilt control of the bucket 155, but the present invention is not limited to this configuration. For example, the control device 190 according to another embodiment may perform the automatic tilt control without performing the stop control of the bucket 155.

In the above-described embodiments, a tilt control amount is calculated based on a difference between the distances of both ends of the edge of the bucket 155 to the target design surface, but the present invention is not limited to this configuration. For example, in another embodiment, a tilt control amount may be calculated based on the tilt angle η measured by the tilt cylinder.

In the above-described embodiments, the control device 190 calculates a tilt control amount based on the difference between the distances of both ends of the edge of the bucket 155 to the target design surface, but the present invention is not limited to this configuration. For example, when one of the first distance L21 and the second distance L22 is less than the tilt control distance th2, the control device 190 according to another embodiment may calculate a tilt control amount based on the other of the first distance L21 and the second distance L22 at that time. For example, when the first distance L21 is less than the tilt control distance th2, the control device 190 may calculate a tilt control amount based on the magnitude of the second distance L22 at that time. In addition, for example, when the distance of either of the first distance L21 or the second distance L22 is a predetermined value or more, the control device 190 may prevent rotation around the tilt axis X4.

In the above-described embodiments, the control device 190 controls the rotation of the bucket 155 around the tilt axis X4, so that the edge of the bucket 155 and the target design surface approach each other in a parallel state, but the present invention is not limited to this configuration. In another embodiment, when the bucket 155 of the work machine 100 is a rotational bucket that is rotatable around a rotation axis, the control device 190 may control rotation around the rotation axis, so that the edge of the bucket 155 and the target design surface approach each other in a parallel state. The rotation axis is one example of the attachment axis.

The control device 190 according to the above-described embodiments always enables the automatic tilt control, but the present invention is not limited to this configuration. The operation device 172 according to another embodiment may include a switch that allows for switching between enabling and disabling of the automatic tilt control. In this case, the control device 190 may determine whether or not to perform the automatic tilt control based on a state of the switch. Namely, in a case where the switch is ON, when there is no tilt operation input (step S8: NO) and the distance between the edge of the bucket 155 and the target plane g1 is less than the tilt control distance th2 (step S9: YES), the control device 190 performs the automatic tilt control. On the other hand, in a case where the switch is OFF, even when there is no tilt operation input and the distance between the edge of the bucket 155 and the target plane g1 is less than the tilt control distance th2, the control device 190 does not perform the automatic tilt control. As long as the switch can be operated by the operator, the switch may be provided as a function of a monitor (not shown) or may be disposed on an operation lever or the like.

In the above-described embodiments, the control device 190 calculates a length threshold value from the tilt control amount, but the present invention is not limited to this configuration. In another embodiment, the length threshold value may be a fixed value.

According to the disclosure, the control system for the work machine is capable of simultaneously performing the intervention control and the automatic tilt control or automatic rotation control while maintaining the stability of operation of the work equipment.

The invention claimed is:

1. A control system for a work machine with work equipment including a boom rotatable around a boom axis, an arm rotatable around an arm axis parallel to the boom axis, and a bucket rotatable around a bucket axis parallel to the arm axis and rotatable around an attachment axis different from the bucket axis, the system comprising:

a distance calculation unit configured to calculate a plurality of bucket distances between each of a plurality of points on the bucket and a target design surface representing a target shape of an excavation target and specify one of the plurality of bucket distances that is shortest among the plurality of bucket distances as a shortest bucket distance;

an intervention control unit configured to calculate an intervention control amount to suppress a speed of the work equipment such that the bucket does not intrude on the target design surface, the intervention control amount being based on the shortest bucket distance;

an attachment control unit configured to calculate an attachment control amount to rotate the bucket around the attachment axis such that an edge of the bucket and the target design surface approach each other in a parallel state; and an attachment limiting unit configured to limit rotation of the bucket around the attachment axis to an allowable control amount or less such that the shortest bucket distance is not increased by a movement of the work equipment based on the intervention control amount and the attachment control amount.

2. The control system for a work machine according to claim 1, wherein when an angle between the edge of the bucket and the target design surface exceeds a predetermined range, the attachment limiting unit prevents rotation of the bucket around the attachment axis.

3. A control system for a work machine with work equipment including a boom rotatable around a boom axis, an arm rotatable around an arm axis parallel to the boom axis, and a bucket rotatable around a bucket axis parallel to the arm axis and rotatable around an attachment axis different from the bucket axis, the system comprising:

a distance calculation unit configured to calculate a bucket distance between a point on the bucket and a target design surface representing a target shape of an excavation target;

an intervention control unit configured to calculate an intervention control amount to suppress a speed of the work equipment such that the bucket does not intrude on the target design surface, the intervention control amount being based on the bucket distance;

an attachment control unit configured to calculate an attachment control amount to rotate the bucket around the attachment axis such that an edge of the bucket and the target design surface approach each other in a parallel state;

an attachment limiting unit configured to limit rotation of the bucket around the attachment axis such that the bucket distance is not increased by a movement of the work equipment based on the intervention control amount and the attachment control amount; and an operation amount acquisition unit configured to acquire an operation amount of the work equipment from an operation device, the intervention control unit calculating an allowable speed of the work equipment based on the bucket distance, and calculating the intervention control amount based on the allowable speed and the operation amount, the attachment control unit calculating the attachment control amount using an attachment function representing a relationship between the bucket distance and the attachment control amount that rotates the bucket around the attachment axis, and the attachment limiting unit changing the attachment function according to the allowable speed.

4. A control system for a work machine with work equipment including a boom rotatable around a boom axis, an arm rotatable around an arm axis parallel to the boom axis, and a bucket rotatable around a bucket axis parallel to the arm axis and rotatable around an attachment axis different from the bucket axis, the system comprising:

a distance calculation unit configured to calculate a bucket distance between a point on the bucket and a target design surface representing a target shape of an excavation target:

an intervention control unit configured to calculate an intervention control amount to suppress a speed of the work equipment such that the bucket does not intrude on the target design surface, the intervention control amount being based on the bucket distance;

an attachment control unit configured to calculate an attachment control amount to rotate the bucket around the attachment axis such that an edge of the bucket and the target design surface approach each other in a parallel state;

an attachment limiting unit configured to limit rotation of the bucket around the attachment axis such that the bucket distance is not increased by a movement of the work equipment based on the intervention control amount and the attachment control amount; and an operation amount acquisition unit configured to acquire an operation amount of the work equipment from an operation device, the intervention control unit calculating an allowable speed of the work equipment based on the bucket distance, and calculating the intervention control amount based on the allowable speed and the operation amount, and the attachment limiting unit calculating an allowable control amount to keep the bucket distance constant based on the allowable speed, and limiting an absolute value of the attachment control amount to the allowable control amount or less.

5. A work machine comprising:

a boom configured to be rotatable around a boom axis;

an arm configured to be rotatable around an arm axis parallel to the boom axis;

a bucket configured to be rotatable around a bucket axis parallel to the arm axis and to be rotatable around an attachment axis orthogonal to the bucket axis; and the control system for a work machine according to claim 1.

6. A method for controlling a work machine with work equipment including a boom rotatable around a boom axis, an arm rotatable around an arm axis parallel to the boom axis, and a bucket rotatable around a bucket axis parallel to the arm axis and rotatable around an attachment axis different from the bucket axis, the method comprising the steps of:

calculating a plurality of bucket distances between each of a plurality of points on the bucket and a target design surface representing a target shape of an excavation target and specifying one of the plurality of bucket distances that is shortest among the plurality of bucket distances as a shortest bucket distance;

calculating an intervention control amount to suppress a speed of the work equipment such that the bucket does not intrude on the target design surface based on the shortest bucket distance;

calculating an attachment control amount to rotate the bucket around the attachment axis such that an edge of the bucket and the target design surface approach each other in a parallel state; and limiting rotation of the bucket around the attachment axis such that the shortest bucket distance is not increased by a movement of the work equipment based on the intervention control amount and the attachment control amount.

7. A work machine comprising:

a boom configured to be rotatable around a boom axis;

an arm configured to be rotatable around an arm axis parallel to the boom axis;

a bucket configured to be rotatable around a bucket axis parallel to the arm axis and to be rotatable around an attachment axis orthogonal to the bucket axis; and the control system for a work machine according to claim 2.

8. A work machine comprising:

a boom configured to be rotatable around a boom axis;

an arm configured to be rotatable around an arm axis parallel to the boom axis;

a bucket configured to be rotatable around a bucket axis parallel to the arm axis and to be rotatable around an attachment axis orthogonal to the bucket axis; and the control system for a work machine according to claim 3.

9. A work machine comprising:

a boom configured to be rotatable around a boom axis;

an arm configured to be rotatable around an arm axis parallel to the boom axis;

a bucket configured to be rotatable around a bucket axis parallel to the arm axis and to be rotatable around an attachment axis orthogonal to the bucket axis; and the control system for a work machine according to claim 4.

* * * * *